US008397838B2

(12) United States Patent
McManus

(10) Patent No.: US 8,397,838 B2
(45) Date of Patent: Mar. 19, 2013

(54) ROTARY ROLLER REAMER

(75) Inventor: Terry Michael McManus, Mawson (AU)

(73) Assignee: Gearhart United Pty Ltd, Wingfield, South Australia (AU)

( * ) Notice: Subject to any disclaimer, the term of this patent is extended or adjusted under 35 U.S.C. 154(b) by 0 days.

(21) Appl. No.: 12/898,043

(22) Filed: Oct. 5, 2010

(65) Prior Publication Data

US 2011/0100722 A1 May 5, 2011

Related U.S. Application Data

(63) Continuation of application No. 10/570,320, filed as application No. PCT/AU2004/001198 on Sep. 3, 2004, now abandoned.

(30) Foreign Application Priority Data

Sep. 3, 2003 (AU) ..... 2003904796

(51) Int. Cl.
*E21B 10/24* (2006.01)

(52) U.S. Cl. ..... 175/227; 175/406; 175/345; 384/94

(58) Field of Classification Search ..... 175/344, 175/345, 288, 406, 227, 228; 384/92, 93, 384/94

See application file for complete search history.

(56) References Cited

U.S. PATENT DOCUMENTS

| | | | | |
|---|---|---|---|---|
| 3,413,045 | A | 11/1968 | William | |
| 3,977,481 | A | 8/1976 | Fisk et al. | |
| 4,102,416 | A | 7/1978 | Hug | |
| 4,254,839 | A | 3/1981 | Schpok et al. | |
| 4,398,610 | A | 8/1983 | Bassinger | |
| 4,480,704 | A | 11/1984 | May et al. | |
| 4,542,797 | A | 9/1985 | Garrett | |
| 5,381,868 | A * | 1/1995 | Schock | 175/346 |
| 2009/0194335 | A1 | 8/2009 | Kennedy et al. | |

FOREIGN PATENT DOCUMENTS

| | | |
|---|---|---|
| AU | B-18591/88 | 1/1989 |
| AU | 81346/94 | 5/1995 |
| AU | B-81346/94 | 5/1995 |
| EP | 0 274 265 A2 | 12/1987 |
| GB | 2 053 319 | 2/1981 |

OTHER PUBLICATIONS

Complete Specification (Application No. AU/594885) dated Jun. 30, 1988.

* cited by examiner

*Primary Examiner* — David Andrews
*Assistant Examiner* — Richard Alker
(74) *Attorney, Agent, or Firm* — Nixon Peabody LLP; Jeffrey L. Costellia

(57) ABSTRACT

A bore hole rotary reamer includes a body having cutters rotatably mounted by one or more respective spindles. A bearing region is formed on the spindle. At least one annular seal prevents ingress of contaminant to the bearing region. A circumferential void is formed adjacent the seal. At least one passageway extends in an axial direction of the spindle to the circumferential void and a piston movable in the passageway in response to supply of pressure to an outer side of the piston from the environment which surrounds the reamer. The piston transfers pressure to fluid in the cylindrical passage on an inner side of the piston to supply pressure to the circumferential void and thereby to the seal. The pressure is substantially determined by the pressure of the environment surrounding the reamer.

17 Claims, 2 Drawing Sheets

ROTARY ROLLER REAMER

FIELD OF THE INVENTION

This invention relates to a bore hole rotary roller reamer. Rotary reamers of this type are used for reaming a hole made by a drill on the end of a drill string. The rotary reamer generally serves the function of maintaining the hole size when wear causes the effective diameter of a drill to reduce and also to smooth the surface of the bore hole.

BACKGROUND

The general construction of commercially successful roller rotary reamers are shown in the applicant's Australian patents 594885 and 675186.

Australian patent 675186 describes a rotary roller reamer in which the pressure of the environment surrounding the reamer is applied to the lubricant supplied to the roller bearing surface by means of a freely floating piston contained in a cylindrical passage. This results in significantly improved lubrication and reduction of the ingress of contaminant material to the bearing surface. Whilst the rotary roller reamer described in Australian patent 675186 has a significantly extended life for the wear components the present invention seeks to provide further improved rotary roller reamer.

The objective of the pressure equalization system described in Australian patent 675186 is to reduce or eliminate the differential pressure across the sealing device provided between the roller and spindle on which it is mounted to prevent ingress of contaminant to the bearing region. The sealing device is often an O-ring or a more complex seal. In the case of O-rings and most other types of seal, a reduction of the differential pressure will reduce the contact pressure between the seal and the sealing surface. This in turn will assist in reducing wear and subsequent seal failure.

In the rotary roller reamer described in Australian patent 675186 the lubricant is supplied to the bearing surface through apertures from a central passage which supply the lubricant to a flat formed on the spindle that effectively provides a passageway extending along the bearing. Thus, the lubricant reaches the seals largely by being transmitted along the bearing surface. It has been recognized in this configuration the bearing itself acts as a pressure barrier partly because of the rotation of the roller at around three times the speed of the drill string. Additionally in the arrangement described in Australian patent 675186 the thrust bearing ball race is also interposed between the supply of lubricant and the seal at one end of the roller. This also acts as a pressure barrier.

DISCLOSURE OF THE INVENTION

It is an object of the present invention to provide an improved rotary roller reamer.

Accordingly, one aspect of this invention provides a bore hole rotary reamer comprising a body having cutters contained in respective recesses formed in the body, each cutter being rotatably mounted by one or more respective spindles and a bearing region formed by an inner bearing surface rotatable on an outer surface of the spindle; at least one annular seal about the spindle to prevent ingress of contaminant to the bearing region; a circumferential void formed between the inner bearing surface and the outer bearing surface of the spindle adjacent said seal; at least one passageway extending in an axial direction of the spindle to said circumferential void; and a piston movable in said passageway in response to supply of pressure to an outer side of said piston from the environment which surrounds the reamer, whereby the piston transfers pressure to fluid in said cylindrical passage on an inner side of said piston to supply pressure to said circumferential void and thereby to said seal that is substantially determined by the pressure of the environment surrounding the reamer.

Preferably the pressure that is applied to the seals via the apertures is substantially the pressure of the environment surrounding the reamer. The piston is preferably freely floatable in the passageway to impart the pressure supplied from the environment which surrounds the reamer to fluid on the inner side of the piston.

In use the fluid on the inner side of the piston is a lubricant and the piston impels a flow of lubricant to the circumferential void to apply pressure to the seal.

In the preferred form of the invention the passageway includes a cylindrical portion extending axially of the spindle that contains the piston. In this form of the invention an aperture preferably communicates between the cylindrical portion and the circumferential void. The aperture is preferably a radially extending aperture.

In the preferred form of the invention annular seals are provided on each of the ends of the bearing region and each annular seal has an adjacent circumferential void. One or more passageway preferably extend to each circumferential void. More preferably, a separate passageway extends to each circumferential void and each passageway includes a movable piston.

Each cutter is preferably rotatably mounted on a central region of a respective spindle and the bearing region is formed by inner surface of the cutter rotatable on an outer surface of the spindle. In this form of the invention a separate passageway preferably respectively extends between each of the circumferential voids and a corresponding outer end of the spindle. It will be apparent that although the preferred form of the invention described an arrangement in which the cutter is rotatably mounted on a central portion of the spindle, in other forms of the invention the cutter can be mounted fixed to a spindle or have spindle portions extending from each end. In these configurations the spindles are rotatably mounted in the body so that the bearing region is formed between an inner surface of body and the outer surface of the spindle.

The circumferential voids are preferably formed by grooves on the outer surface of the spindle or by grooves on the inner bearing surface.

It will be apparent that the use of two freely floating pistons in the preferred form of the invention respectively in passageways between the respective one of the void and the adjacent outer end of the spindle provides significant advantages over the prior art. In particular the lubricant in each cylindrical passage is independently pressurized and caused to flow through the apertures to the circumferential voids. The use of the two pistons improves the transmission of the pressure of the environment to the lubricant and ultimately to the voids adjacent the seals.

The provision of the circumferential voids adjacent the seals spaces the seals from the bearing surface. This is thought to be a further advantage of the invention because the fluid filled load carrying bearing also generates its own internal pressure to carry the load. The interposing of the circumferential voids between the load carrying region and the seals serves to reduce or eliminate any effect that this pressure has on the pressure applied to the seal. In some embodiments the void may need to be spaced a small distance from the seal. In this case additional clearance is provided between the outer surface of the spindle and inner surface of the cutter so that there is no bearing between the void and seal.

The rotary roller reamer of this invention thus provides improved equalization of the pressure across the seals which extends the seal life and consequently the life of the wear components of the reamer.

Embodiments of the invention will now be described, by way of example only, with reference to the accompanying drawings.

BEST MODE FOR CARRYING OUT THE INVENTION

The rotary roller reamer 1 of this invention has a number of components of substantially conventional type as described in Australian patents 594885 and 675186, the contents of which are incorporated herein by cross reference.

Figure 1A:
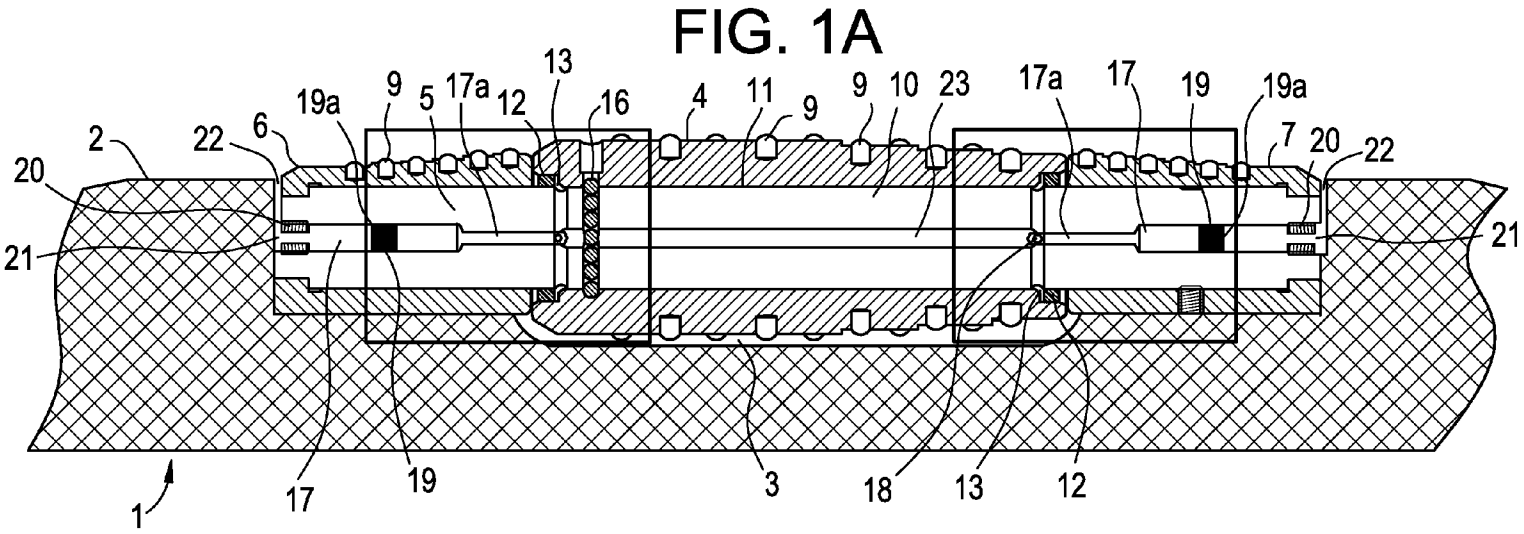
FIG. 1A is a schematic cross section of part of a rotary roller reamer according to a first embodiment of the present invention.
Figure 1C:
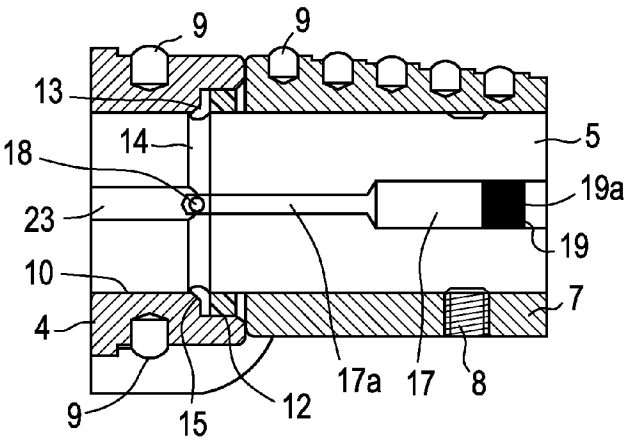
FIGS. 1B and 1C are enlarged scrap sections of the indicated portions of FIG. 1A.
Figure 1B:
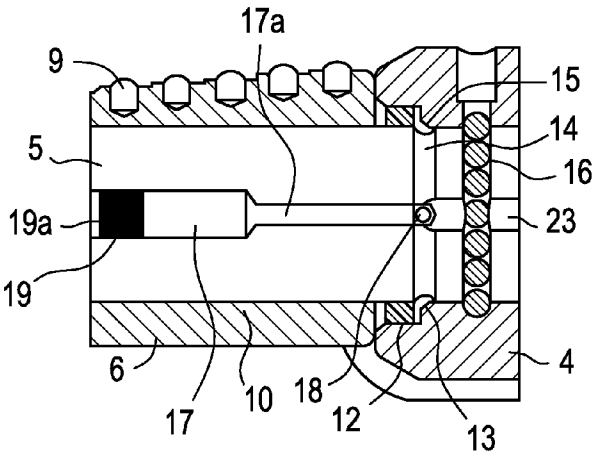

As shown in FIGS. 1A to 1C the rotary roller reamer 1 of the first embodiment has a body 2 in which recesses 3 (only one is shown) are formed to receive a roller or cutter 4. As will be appreciated by those skilled in the art a number of cutters 4 are mounted in similar recesses around the circumference of the reamer body 2. The cutter 4 is rotatably mounted in a central region of spindle 5. Spindle 5 is retained in the body 2 by top block 6 and bottom block 7. Blocks 6 and 7 are retained in the body 2 using the wedge system (not shown) described in the applicant's Australian patents 584885 and 615186. The spindle 5 is retained by an interference fit in the top 6 and in the bottom block by grub screw 8. Both the cutters 4 and blocks 6, 7 have a number of tungsten carbide inserts 9 of conventional type to reduce wear.

A bearing region 10 is formed by an inner bearing surface 11 of cutter 4 that is rotatable on an outer surface of the spindle. Annular seals 12 are interposed between the cutter 4 and spindle 5 at each end of the bearing region 10. The seals 12 are a lip type and prevent ingress of contaminant into the bearing region 10. Circumferential voids 13 are formed adjacent each seal 12. Each void is partly formed by a circumferential groove 14 in the spindle 5 and a circumferential groove 15 adjacent the seal formed in the inner surface 11 of cutter 4. A conventional thrust race 16 of steel bearings to absorb longitudinal forces is provided toward one end of the cutter 4. Cylindrical passageways 17 extends axially from each outer end of the spindle 5. Two smaller passageway portions 17*a* connect to piston apertures 18 to provide communication between the cylindrical passageway 17 and the circumferential voids 13. Freely floating pistons 19 are provided in each of the passageways 17. Removable annular bungs 20 at the end of each passageway 17 are provided for removal of the piston and charging of the cylindrical passageway 17 with lubricant such as grease. Annular bungs 20 have a central hole 21 which provides communication via a breather aperture 22 to the environment around the reamer body 2. A flat 23 is formed on the outer surface between apertures 18 to provide a passageway for the flow of lubricant along the spindle 5. The passageway can be formed by another shape or groove to give a larger cross sectional area.

It will be apparent that the freely floating pistons 19 are provided on their outer ends 19*a* with a pressure substantially equal to the pressure of the environment surrounding the reamer body 2. The freely floating pistons 19 transmit this pressure to the lubricant contained in cylindrical passageway 17. This causes the lubricant to be forced through apertures 18 into voids 13 and along flat 23 to lubricate the bearing region 10. The lubricant forced into void 13 applies a pressure to the respective adjacent seal 12 that is substantially equal to the pressure surrounding the reamer body 2.

By providing a more effective communication of the pressure surrounding the reamer to the interior of the seals the pressure differential across the seal is minimized. As a result the seal life is considerably extended and consequently the life of the bearings considerably extended. Additionally it will be appreciated that the voids 13 provide a spacing between the effective bearing surface of the cutter 4 and the seals. This spacing, and the transmission of the external pressure to those voids reduces or eliminates the transmission of the pressure generated by the rotation of the bearing itself to the seals 12.

Figure 2A:
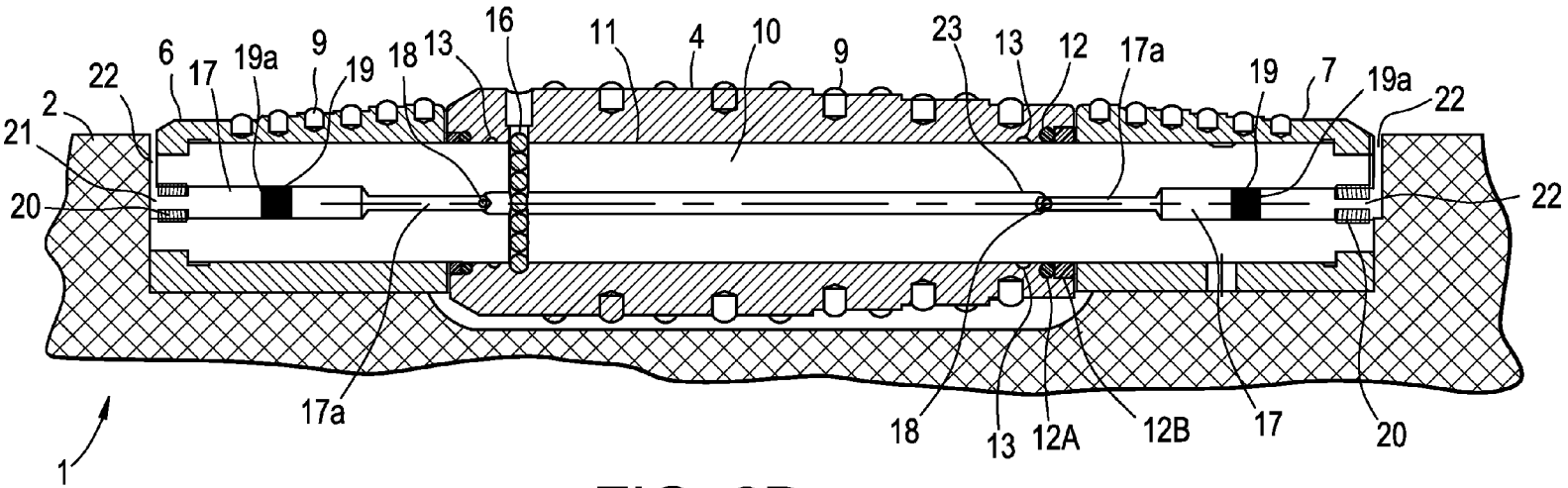
FIG. 2A is a schematic cross section similar to FIG. 1 showing a second embodiment of the present invention.
Figure 2B:
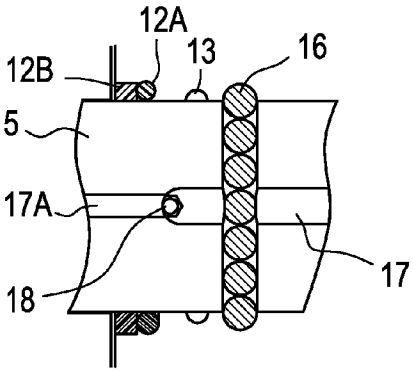
FIG. 2B is an enlarged scrap section of part FIG. 2A.

FIGS. 2A and 2B show a rotary roller reamer 1 according to a second embodiment. Most of the components are common with the first embodiment and the same reference numerals have been used. In the second embodiment voids 13 are formed on annular grooves in the inner surface 11 of cutter 4. The seal 12 is formed by an O-ring 12A and packing 12B. A clearance is provided between cutter 4 and inner surface 11 of cutter 4 in the region between seal 12 and void 13 to prevent the generation of pressure by rotation of the cutter. In all other respects the rotary reamer shown in FIG. 2 operates in the manner described above for the FIG. 1 embodiment.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as an acknowledgement or any form of suggestion that that prior art forms part of the common general knowledge in Australia.

The foregoing describes only one embodiment of the present invention and modifications can be made without departing from the scope of the invention.

What is claimed is:

1. A bore hole rotary reamer comprising:

a body having cutters contained in respective recesses formed in the body, each cutter being rotatably mounted by a respective spindle and having a bearing region formed by an inner bearing surface rotatable on an outer bearing surface of the respective spindle;

annular seals about the respective spindle, one of which is located at each end of said bearing region to prevent ingress of contaminant to the bearing region;

circumferential voids formed between the inner bearing surface and the outer bearing surface of the respective spindle, each of said circumferential voids being located adjacent a respective one of said seals;

passageways that each extend in an axial direction of the respective spindle to a respective one of said circumferential voids; and pistons that are each movable in a respective one of said passageway passageways in response to supply of pressure to an outer side of said pistons from the environment which surrounds the reamer, whereby the pistons transfer pressure to fluid in said passageways on an inner side of said pistons to supply pressure to said circumferential voids and thereby to said seals, said pressure being substantially determined by the pressure of the environment surrounding the reamer.

2. A bore hole rotary reamer according to claim 1, wherein the pressure that is applied to said seals via said passageways is substantially the pressure of the environment surrounding the reamer.

3. A bore hole rotary reamer according to claim 1, wherein said pistons are freely floatable in said passageways to impart the pressure supplied from the environment which surrounds the reamer to fluid on said inner side of the pistons.

4. A bore hole rotary reamer according to claim 1, wherein, in use, the fluid on said inner side of said pistons is a lubricant and said pistons impel a flow of lubricant to said circumferential voids to apply pressure to said seals.

5. A bore hole rotary reamer according to claim 1, wherein said passageways include cylindrical portions extending axially of the respective spindle containing said pistons and apertures communicating between said cylindrical portions and said circumferential voids.

6. A bore hole rotary reamer according to claim 1, wherein each cutter is rotatably mounted on a central region of the respective spindle and said bearing region is formed by an inner surface of the cutter rotatable on an outer surface of the respective spindle.

7. A bore hole rotary reamer according to claim 1, wherein said circumferential voids are formed by a groove on the outer surface of the respective spindle.

8. A bore hole rotary reamer according to claim 1, wherein said circumferential voids are formed by a groove in said inner bearing surface.

9. A bore hole rotary reamer comprising:

a body having cutters contained in respective recesses formed in the body, each cutter being rotatably mounted by a respective spindle and having a bearing region formed by an inner bearing surface rotatable on an outer bearing surface of the spindle;

annular seals about the spindle, one of which is located at each end of said bearing region to prevent ingress of contaminant to the bearing region;

circumferential voids formed between the inner bearing surface and the outer bearing surface of the spindle, each of said circumferential voids being located adjacent a respective one of said seals;

passageways that each extend in an axial direction of the spindle from an end of the respective spindle to a respective one of said circumferential voids; and pistons that are each movable in a respective one of said passageways in response to supply of pressure to an outer side of said pistons from the environment which surrounds the reamer, whereby each piston transfers pressure to fluid in said respective passageway on an inner side of said pistons to supply pressure to said circumferential voids and thereby to said seals, said pressure being substantially determined by the pressure of the environment surrounding the reamer;

wherein each cutter is rotatably mounted on a central region of a respective spindle.

10. A bore hole rotary reamer according to claim 9, wherein the pressure that is applied to each of said seals via said passageways is substantially the pressure of the environment surrounding the reamer.

11. A bore hole rotary reamer according to claim 9, wherein said pistons are freely floatable in said passageways to impart the pressure supplied from the environment which surrounds the reamer to fluid on said inner side of the pistons.

12. A bore hole rotary reamer according to claim 9, wherein, in use, the fluid on said inner side of said pistons is a lubricant and said pistons impel a flow of lubricant to said circumferential voids to apply pressure to said seals.

13. A bore hole rotary reamer according to claim 9, wherein said passageways include cylindrical portions extending axially of the spindle containing said pistons, and apertures communicating between said cylindrical portions and said circumferential voids.

14. A bore hole rotary reamer according to claim 9, wherein said circumferential voids are formed by grooves on the outer surface of the spindle.

15. A bore hole rotary reamer according to claim 9, wherein said circumferential voids are formed by grooves in said inner bearing surface.

16. A bore hole rotary reamer comprising:

a body having cutters contained in respective recesses formed in the body, each cutter being rotatably mounted in a central region of a respective spindle and having a bearing region formed by an inner bearing surface of the cutter rotatable on an outer bearing surface of the spindle;

annular seals interposed between the cutter and spindle at each end of the bearing region to prevent ingress of contaminant;

circumferential voids respectively formed between the inner bearing surface and the outer bearing surface of the spindle at each end of the bearing region adjacent each said seal, cylindrical passages extending in an axial direction in each spindle, and respective apertures that each extend from one of said cylindrical passages to one of said circumferential voids; and pistons that are each freely floatable in a respective one of said cylindrical passages between an outer end of said cylindrical passage and said respective aperture, an outer end of said pistons being supplied with pressure substantially equal to the pressure of the environment which surrounds the reamer, whereby each piston imparts that pressure to lubricant when contained in said respective cylindrical passage and impels a flow of said lubricant to said respective circumferential void to apply a lubricant pressure to said respective seal that is substantially the pressure of the environment surrounding the reamer.

17. A bore hole rotary reamer comprising:

a body having cutters contained in respective recesses formed in the body, each cutter being rotatably mounted in a central region of a respective spindle and having a bearing region formed by an inner bearing surface of the cutter rotatable on an outer bearing surface of the spindle;

annular seals interposed between the cutter and spindle at each end of the bearing region to prevent ingress of contaminant;

circumferential voids respectively formed between the inner bearing surface and the outer bearing surface of the spindle at each end of the bearing region adjacent each said seals, cylindrical passages that each extend in an axial direction in each spindle from an end of the respective spindle, and respective apertures that each extend from one of said cylindrical passages to one of said circumferential voids; and pistons that are each freely floatable in a respective one of said cylindrical passages between an outer end of said cylindrical passage and said respective aperture, an outer end of said pistons being supplied with pressure substantially equal to the pressure of the environment which surrounds the reamer, whereby each piston imparts that pressure to lubricant when contained in said respective cylindrical passage and impels a flow of said lubricant to said respective circumferential void to apply a lubricant pressure to said respective seal that is substantially the pressure of the environment surrounding the reamer.

* * * * *